US006747605B2

(12) United States Patent
Lebaric et al.

(10) Patent No.: US 6,747,605 B2
(45) Date of Patent: Jun. 8, 2004

(54) PLANAR HIGH-FREQUENCY ANTENNA

(75) Inventors: Jovan E. Lebaric, Carmel, CA (US); Arie Shor, Sunnyvale, CA (US)

(73) Assignee: Atheros Communications, Inc., Sunnyvale, CA (US)

( * ) Notice: Subject to any disclaimer, the term of this patent is extended or adjusted under 35 U.S.C. 154(b) by 0 days.

(21) Appl. No.: 10/140,335

(22) Filed: May 6, 2002

(65) Prior Publication Data

US 2002/0190912 A1 Dec. 19, 2002

Related U.S. Application Data

(60) Provisional application No. 60/289,448, filed on May 7, 2001.

(51) Int. Cl.[7] ..... H01Q 9/28
(52) U.S. Cl. ..... 343/795; 343/700 MS
(58) Field of Search ..... 343/795, 700 MS, 343/820–822, 850–853, 859, 860, 864

(56) References Cited

U.S. PATENT DOCUMENTS

| | | | | |
|---|---|---|---|---|
| 4,438,437 A | | 3/1984 | Burgmyer | 343/770 |
| 4,635,070 A | | 1/1987 | Hoover | 343/852 |
| 4,825,220 A | * | 4/1989 | Edward et al. | 343/795 |
| 5,293,175 A | * | 3/1994 | Hemmie et al. | 343/795 |
| 5,532,708 A | | 7/1996 | Krenz et al. | 343/795 |
| 5,708,446 A | | 1/1998 | Laramie | 343/815 |
| 5,754,145 A | | 5/1998 | Evans | 343/795 |
| 5,914,695 A | | 6/1999 | Liu et al. | 343/795 |
| 5,977,928 A | | 11/1999 | Ying et al. | 343/790 |
| 6,014,112 A | | 1/2000 | Koscica et al. | 343/795 |
| 6,037,911 A | | 3/2000 | Brankovic et al. | 343/795 |
| 6,175,338 B1 | * | 1/2001 | Quade | 343/795 |
| 6,198,443 B1 | | 3/2001 | Powles et al. | 343/702 |
| 6,204,826 B1 | | 3/2001 | Rutkowski et al. | 343/895 |
| 6,218,990 B1 | | 4/2001 | Grangeat et al. | 343/700 MS |
| 6,222,494 B1 | | 4/2001 | Erkocevic | 343/790 |
| 6,326,921 B1 | | 12/2001 | Egorov et al. | 343/700 MS |
| 6,337,666 B1 | | 1/2002 | Bishop | 343/795 |
| 6,337,667 B1 | | 1/2002 | Ayala et al. | 343/795 |
| 6,339,406 B1 | | 1/2002 | Nesic et al. | 343/797 |
| 6,377,227 B1 | | 4/2002 | Zhu et al. | 343/795 |

OTHER PUBLICATIONS

Copy of International Search Report dated Sep. 5, 2002 for PCT/US02/14479.

Copy of International Search Report dated Nov. 12, 2002 for PCT/US02/23678.

* cited by examiner

*Primary Examiner*—Hoang V. Nguyen
(74) *Attorney, Agent, or Firm*—John W. Carpenter; Reed Smith LLP

(57) ABSTRACT

The present invention provides a planar antenna having a scalable multi-dipole structure for receiving, and transmitting high-frequency signals, including a plurality of opposing layers of conducting strips disposed upon either side of an insulating (dielectric) substrate. The dipoles are bifurcated between sides of a substrate on which the dipoles are disposed. A feed line is balanced to a co-axial cable and feeds one half of the bifurcated dipoles, and an independent feed line is connected to the other half of the bifurcated dipoles. Sets of the dipoles are arranged symmetrically around a center axis of the feed lines. The sets of dipoles are in series with other sets of dipoles. The antenna is ideally suited for operation in the 5.15–5.35 GHz RF band.

49 Claims, 3 Drawing Sheets

PLANAR HIGH-FREQUENCY ANTENNA

CROSS REFERENCE TO RELATED APPLICATIONS AND CLAIM OF PRIORITY

This invention claims priority to the following co-pending U.S. provisional patent application, which incorporated herein by reference, in its entirety:

Shor, et al., Provisional Application Serial No. 60/289,448, entitled "PLANAR HIGH-FREQUENCY ANTENNA," filed May 7, 2001.

The present application is related to U.S. patent application Ser. No. 10/140,336, entitled "PARALLEL-FEED PLANAR HIGH FREQUENCY ANTENNA", filed on the same date as the present application; and Ser. No. 10/140,339, entitled "DUAL-BAND PLANAR HIGH FREQUENCY ANTENNA", filed on the same date as the present application, the contents of each are incorporated herein by reference in their entirety.

BACKGROUND OF THE INVENTION

1. Field of Invention

The present invention relates generally to the field of high frequency antennas, and more particularly to the field of high-gain, multi-dipole array antennas constructed using inexpensive manufacturing techniques.

2. Discussion of Background

The U.S. Federal Communications Commission (FCC) allocates a certain number of frequency bands where a license is not required for use. For example, many garage-door openers operate in the unlicensed 49 MHz band. Similarly, the unlicensed 2.4 GHz frequency band has become popular for connecting computers to a wireless LAN.

Unfortunately, the 2.4 GHz band available in the U.S. and worldwide hosts a myriad of devices and competing communications standards that have led to increasing interference and degraded performance in the wireless networking world. Devices operating at 2.4 GHz include common household items such as microwave ovens, cordless phones and wireless security cameras, in addition to the myriad computing devices that are wirelessly networked together. To add to the confusion, the industry has deployed multiple standards for wireless networking at 2.4 GHz. The IEEE 802.11b standard is, as of the filing date hereof, most commonly used for enterprise wireless LANs. The Home RF standard also exists for wireless LANs in the home, and Bluetooth has been developed as a short-distance wireless cable replacement standard for short-range, low-rate applications.

The interference and performance issues at 2.4 GHz have the wireless LAN industry headed for the open 5.15 to 5.35 GHz frequency band, where the opportunity exists for a much cleaner wireless networking environment. The allocated unlicensed 5 GHz band is devoid of interference from microwave ovens and, in the U.S., provides more than twice the available bandwidth of the allocated unlicensed 2.4 GHz band, thereby allowing for higher data throughput and more simultaneous users, and the potential for multimedia application support. This open 5 GHz spectrum provides an opportunity for the potential creation of a unified wireless protocol that will support a broad range of devices and applications. Everything from cordless phones to high-definition televisions and personal computers can communicate on the same multipurpose network under a single unified protocol. As a result, an antenna operating in the unlicensed frequency band above 5 GHz would encourage the creation and support of a wide range of low and high data rate devices that could all communicate on a single wireless network.

As to antenna design to take advantage of the above described opportunity for high-frequency wireless communication, the industry's foremost objective is to provide antennas having (1) the lowest possible manufacturing costs with consistently uniform performance, (2) high gain, (3) high directivity when desired, and (4) design characteristics that can be applied in both the current majority-used frequency bands (such as 2.4 GHz) and the newly utilized bands (particularly between 5 GHz and 6 GHz).

Conventional dipole antennas (also commonly known as Franklin antennas), in which each member of a pair of fractional wavelength radiators are fed in anti-phase, produce a substantially omni-directional radiation pattern in a plane normal to the axis of the radiators. However, providing such an omni-directional structure on a substantially planar (and inexpensively produced) surface, such as a printed circuit board substrate, has proven a challenge. Existing attempts to achieve such planarity and performance rely on vias that penetrate the substrate to interconnect a plurality of conducting planes, thereby adding substantially to the cost of the antenna.

U.S. Pat. No. 5,708,446 discloses an antenna that attempts to provide substantially omni-directional radiation pattern in a plane normal to the axis of the radiators. The patent discloses a corner reflector antenna array capable of being driven by a coaxial feed line. The antenna array comprises a right-angle corner reflector having first and second reflecting surfaces. A dielectric substrate is positioned adjacent the first reflective surface and contains a first and second opposing substrate surfaces and a plurality of dipole elements, each of the dipole elements including a first half dipole disposed on the first substrate surface and a second half dipole disposed on the second substrate surface. A twin line interconnection network, disposed on both the first and second substrate surfaces, provides a signal to the plurality of dipole elements. A printed circuit balun is used to connect the center and outer conductors of a coaxial feed line to the segments of the interconnection network disposed on the first and second substrate surfaces, respectively.

However, in order to connect the coaxial cable to the interconnection network, U.S. Pat. No. 5,708,446 requires a via to be constructed through the substrate. This via's penetration through the substrate requires additional manufacturing steps and, thus, adds substantially to the cost of the antenna.

Furthermore, other attempts require branched feed structures that further increase the number of manufacturing steps and thereby increase the cost of the antenna. A need exists to use fewer parts to assemble the feed so as to reduce labor costs. Present manufacturing processes rely on a substantial amount of human skill in the assembly of the feed components. Hence, human error enters the assembly process and quality control must be used to ferret out and minimize such human error, which adds to the cost of the feed.

Such human assembled feeds also provide inconsistent performance. For example, U.S. Pat. No. 6,037,911 discloses a phased array antenna comprising a dielectric substrate, a plurality of dipole means, each comprising a first and a second element, the first elements being printed on the front face and pointing in a first direction and the second elements being printed on the back face, and a metal strip means comprising a first line printed on the front face and coupled to the first element and a second line printed on the back face and coupled to the second element. A reflector means is also spaced to and parallel with the back face of the dielectric substrate and a low loss material is located between the reflector means and the back face, whereby the first and second lines respectively comprise a plurality of first and second line portions and the first and second line portions respectively being connected to each other by T-junctions. However, in order to provide a balanced, omni-directional performance, U.S. Pat. No. 6,037,911 requires a branched feed structure through the utilization of T-junctions. These T-junctions add complexity to the design and, again, increase the cost of the antenna.

SUMMARY OF THE INVENTION

To address the shortcomings of the available art, the present invention provides a planar antenna having a scalable multi-dipole structure for receiving, and transmitting high-frequency signals, including a plurality of opposing layers of conducting strips disposed upon either side of an insulating (dielectric) substrate.

In one embodiment, the present invention is an antenna in which each dipole is bifurcated along a horizontal axis, with one half of a dipole disposed on one side of a substantially planar insulating layer and the other half disposed on the other side of the insulating layer. Additionally, each dipole half is in electrical communication with a feed structure independent of its other half, and a plurality of dipoles are preferably dispersed symmetrically along the feed structure.

In another embodiment, the present invention is an antenna that is optimized to function between 5.15 and 5.35 GHz, preferably with a center frequency of 5.25 GHz. In an alternative, higher gain embodiment of the present invention, a plurality of dipoles is vertically integrated along the feed structure to create a serial, co-linear antenna.

Advantages of the present invention include: provision of a highly effective dipole structure in an inexpensive, printed implementation (printed radiating elements on opposing sides of a planar, insulating substrate); the integration of a balun with an antenna feed on a planar substrate; and, provision of a feed line and feed line branches to each of a plurality of radiating elements such that an excellent impedance match is obtained over a wide frequency range. Also, the inventive antenna's lack of vias and inclusion of balanced, independent feed structures significantly reduces system design time, manufacturing costs and utilized materials. Preferably, cost is further minimized through the use of standard manufacturing processes and eliminating the introduction of human error.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

It should be understood that the figures are intended only to illustrate the invention. Only any claims that issue henceforth and their equivalents should be used to limit the invention and the coverage provided by any issued patent.

DESCRIPTION OF THE PREFERRED EMBODIMENTS

Figure 1:
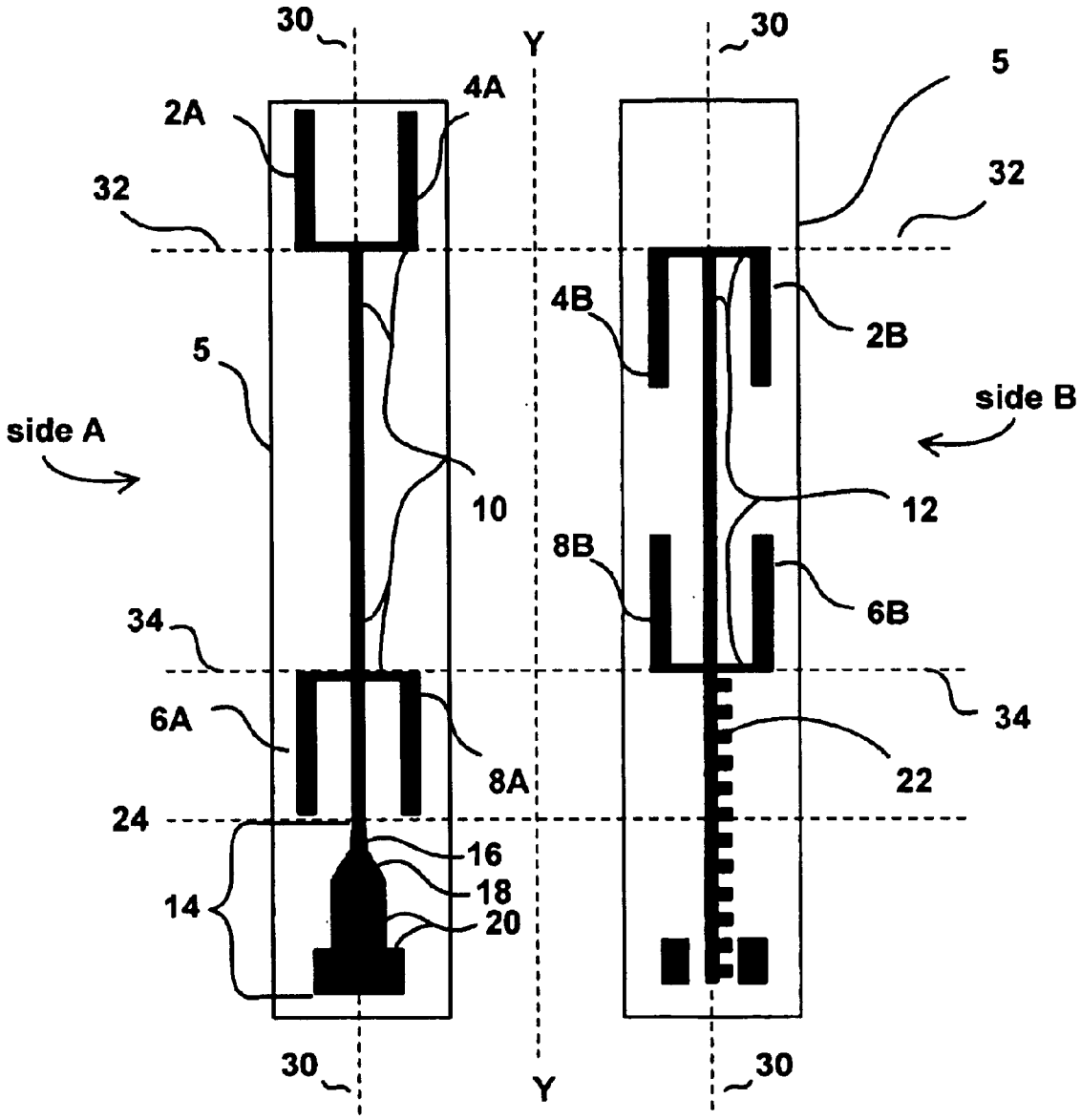
FIG. 1 illustrates in two views a preferred embodiment of the invention, providing separate views of either side of a thin, planar dielectric substrate having the antenna structure deposited thereupon, including dipoles and feed structures.

FIG. 1 illustrates a planar antenna 1 having a scalable, half-wavelength multi-dipole structure for receiving and transmitting high-frequency signals. Two sides, Side A and Side B, provide two views of the dielectric substrate 5's opposing sides, flipped along vertical axis Y. Antenna 1 includes two layers of conducting (preferably) metallic strips disposed upon opposing sides of the insulating substrate 5. A plurality of half wavelength dipoles 2, 4, 6, and 8 are positioned in series along feed structures 10 and 12. Each dipole is preferably bifurcated between side A and side B of substrate 5 and each quarter-wavelength dipole half (e.g., 2A and 2B) is separately connected to either of feed structures 10 and 12, respectively. Dipoles 2 and 4 are bifurcated along a horizontal axis 32 and dipoles 6 and 8 are bifurcated along a horizontal axis 34. The dipoles' bifurcation and placement along opposing sides of substrate 5 eliminates the need for additional substrate layers and vias to accommodate a singular antenna feed structure.

To ensure balanced, omni-directional performance, the dipole parts are symmetrically positioned about a line of symmetry 30, which oriented along the vertical centerline of the feed structures 10 and 12. The provided structure thereby compensates for the phase shift of approximately 180 degrees between stacked dipoles (since the distance between the two adjacent stacked dipoles is about one-half of a wavelength). Since alternate radiating elements of adjacent dipoles are connected to the same feed line, an additional 180 degrees of phase shift is provided, thereby providing a total phase shift of 360 degrees between adjacent dipoles in the stack, that is, equal phase for all radiating dipoles at the center frequency of the operating range.

Balun structure 14, including tapered portions 16 and 18 and lower portion 20, provides the balanced performance characteristics required of feed structures 10 and 12 above designated balance point 24 on both structures. Feed structures 10 and 12 are preferably connected to two conductors in electrical communication with a transceiver, which conductors are presented in a coaxial configuration (not shown), with an outer conductor (typically ground) in communication with antenna side A and an inner conductor (typically an active signal) in communication with antenna side B. In the illustrated example, structure 10, including tapered balun structure 14, is connected to the outer-grounded conductor, while structure 12 is connected to the inner conductor. Contact points 22 are preferably, though optionally, provided for testing and to fine-tune input/output impedance matching as needed.

Balun structure 14 includes two sub-parts, one on each side of substrate 5 and best illustrated with reference to FIG. 2. The side A (grounded) tapered balun components comprise rectangular conductors 19 and 21 (disposed on each side of the antenna longitudinal plane of symmetry) that provide a soldering surface for the coaxial connection described above (not shown). On the grounded side A, each rectangle is joined with gradually tapering structure 14 and converges towards the antenna centerline, eventually merging to a single conducting strip opposite the "signal" strip on the opposite side of substrate 5. This twin-symmetric, converging balun structure provides a transition from the unbalanced coaxial cable (or other feed configuration) to a balanced parallel strip feed line and also provides proper wideband impedance matching for the desired transceiver.

Side B provides a complementary feed structure and rectangular traces for receiving, for example, the coaxial connector.

Balun 14 is therefore a significant component of the inventive antenna, as it allows the antenna to operate equally well with or without a ground plane. In a preferred embodiment, the balun and feed line dimensions are optimized to provide a wideband impedance match while maintaining a very small balun size. Typically, printed planar baluns are one to two operating wavelengths long, while the preferred inventive embodiment is about one-quarter wavelength long and thus enables, in part, substantial (about a factor of two) reduction of the overall antenna length.

Additionally, because antenna 1 provides a low loss line structure, it is possible to use for the substrate 5 a dielectric of a standard quality, and thus of low cost, without considerably reducing the efficiency of the antenna. Substrate 5 is preferably between approximately 100 and 700 micrometers thick to provide sufficient rigidity to support the antenna structure. Because of the simplicity of production and elements and the low cost of the raw materials, the cost of the antenna is considerably lower than for more complicated high frequency antennas.

Figure 2:
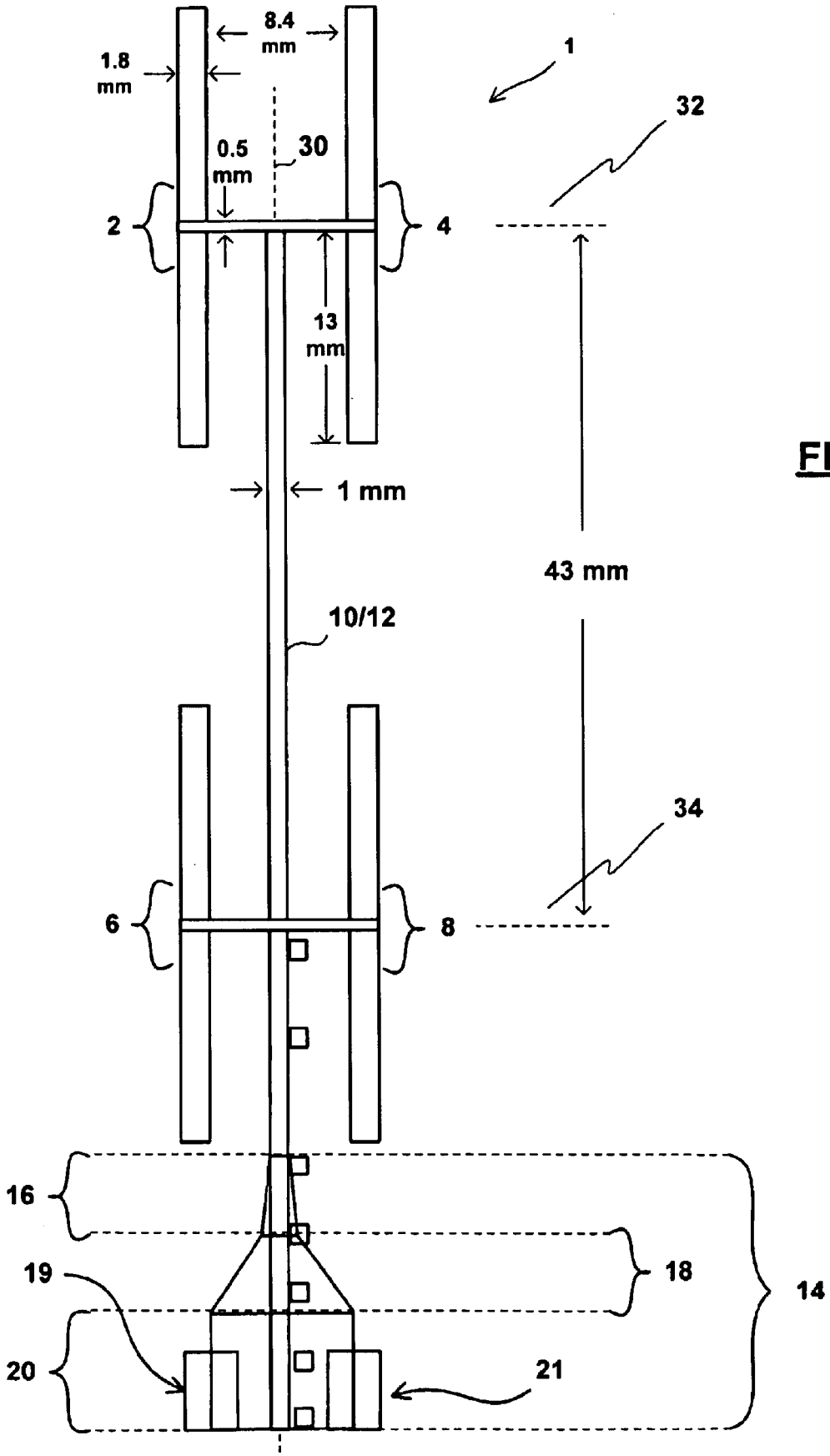
FIG. 2 illustrates in a single view the equivalent structure of FIG. 1 without illustrating the dielectric substrate or bifurcation of the dipoles, including dimensions of an embodiment preferred for application to the frequency range from substantially 5.15 to 5.35 GHz.

FIG. 2 provides an idealized illustration of antenna 1 having dimensions optimized for a transceiver functioning between 5.15 and 5.35 GHz, the two sides A and B being superimposed onto a single line drawing. Feed structure 10 includes tapered balun 14 and a vertical portion 1-mm wide and horizontal portions each 0.5-mm wide. Feed structure 12 also includes vertical and horizontal portions having preferably the same dimensions as feed structure 10. However, as with each of the preferred dimensions discussed herein, other lengths or widths may be utilized depending on the desired center frequency of the antenna. The length of the horizontal portions spacing the dipoles is preferably 8.4 mm, while each dipole quarter-wavelength portion is preferably 1.8 mm wide and 13 mm long. The preferred structure thereby provides a total end-to-end horizontal spread between dipoles of 12 mm (thereby optimizing gain without diminishing the omni-directional nature of the intended performance characteristics) and vertical spread of 43 mm (providing full wavelength vertical separation between the dipole pairs while accommodating the imperfect insulating properties of dielectric substrate 5).

Wireless devices typically include a transmitter and receiver to an antenna that emits and receives signals to and from a base station. For example, in the wireless environment, designers are often interested in maximizing the uplink (mobile to base station) and downlink (base station to mobile station) range. Any increase in range means that fewer cells are required to cover a given geographic area, hence reducing the number of base stations and associated infrastructure costs. The link's range, either the uplink or the downlink, and the network's overall strength can be improved via two approaches. One approach is to increase the transceiver's power in order to increase the range and thus the overall strength of the network. The second approach is to increase the receiver's gain.

Figure 3:
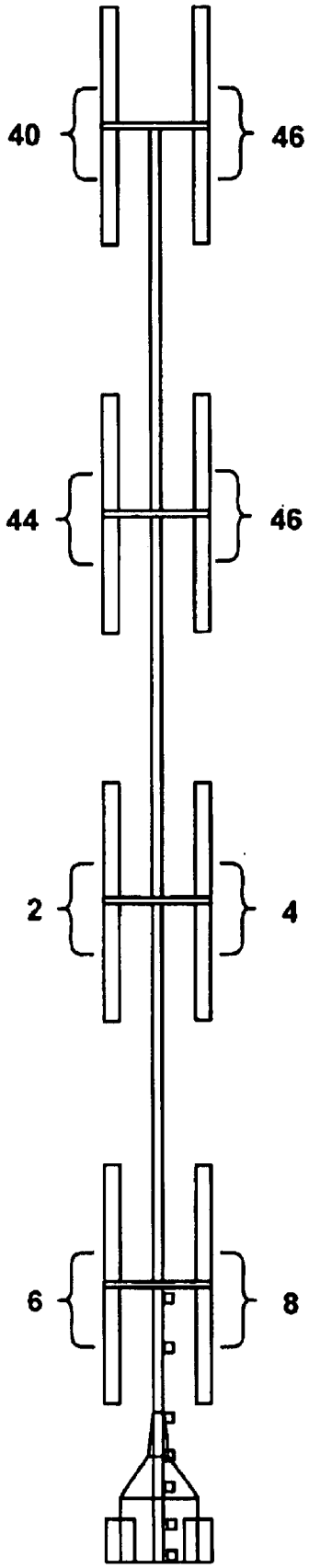
FIG. 3 illustrates an alternative, higher gain embodiment of the present invention, wherein additional dipole structures are included in series with primary dipoles as illustrated in FIGS. 1 and 2.

FIG. 3 illustrates an alternative, higher gain embodiment of the antenna, wherein additional dipole structures (e.g. 40, 42, 44, 46) are included in a co-linear series with the primary dipoles (e.g. 2, 4, 6, 8) illustrated in FIGS. 1 and 2. This co-linear, serial embodiment continues to provide full in-phase feeding of the array elements. The antenna's gain is enhanced without disturbing other antenna performance characteristics by vertically stacking a second set of dipoles separated from the first set by a dipole separation distance, preferably an approximate distance of 43 mm. Separation distances may be calculated based on same phase 360-degree phase differential of signals emanating from the dipoles. Bifurcated dipoles symmetrically opposed (e.g., dipole 2 and dipole 4) are fed in phase, while the individual dipole elements of a single bifurcated dipole (e.g. element 2A and element 2B of dipole 2) are fed in anti-phase. The physical distance between the dipoles (see FIG. 2) is approximately 43 mm, which is less than one wavelength (~0.7 of a wavelength). The dielectric constant of the feed lines is approximately 3.4 and thus causes a shortening of the wavelength in the feed lines compared to the wavelength in air (with a dielectric of 1), and the physical distance between dipoles is set accordingly. With a dielectric constant of approximately 3.4, the illustrated feed structures shorten the wavelength to approximately 70–80% of the wavelength in air, which corresponds approximately to the 43 mm physical distance between dipoles. Other dipole separation distance values may vary depending on the desired frequency.

It should be noted that a significant goal of the wireless communication industry is to manufacture antennas that provide superior directivity. The antenna of the present invention satisfies this goal as well. The antenna's combination of multiple, co-linear dipoles in series provides enhanced antenna directivity: that is, the elevation pattern is highly focused. However, by varying the vertical distance between dipoles, the elevation pattern can be altered. If, for example, a transceiver is located at a high point substantially above a wireless network dispersed on a lower plane, the elevation pattern may be directed downward to increase effectiveness by tilting the beam.

Finally, it will be clear that the invention is not limited to the transmission or reception of ~5 GHz low power signals. The invention can be used with all types of high-frequency transmission networks. Also, the exemplary choice of the frequency of 5.15 to 5.35 GHz should not exclude coverage for other operating frequencies in the high-frequency range. For example, by turning the illustrated antenna on its side and connecting the balun at the center of the structure, a broader bandwidth embodiment could be constructed, as will be understood by those skilled in the art to which the present invention pertains.

In describing preferred embodiments of the present invention illustrated in the drawings, specific terminology is employed for the sake of clarity. However, the present invention is not intended to be limited to the specific terminology so selected, and it is to be understood that each specific element includes all technical equivalents that operate in a similar manner. For example, when describing a feed line, any other device having equivalent structure, function, or capability, whether or not listed herein, may be substituted therewith. Furthermore, the inventors recognize that those newly developed technologies not now known may also be substituted for the described parts and still not depart from the scope of the present invention. All other described items, including, but not limited to feed lines, horizontal portions, balun, dipoles, substrates, etc should also be consider in light of any and all available equivalents.

Obviously, numerous modifications and variations of the present invention are possible in light of the above teachings.

It will be understood that the disclosed embodiments are of an exemplary nature and that the method and system is to be limited only by any claims that issue henceforth and their equivalents. The invention may be practiced otherwise than as specifically described herein.

What is claimed and desired to be secured by Letters Patent of the United States is:

1. A substantially planar antenna having a dipole structure for receiving and transmitting high-frequency signals, comprising:

a substrate;

a first feed line disposed on a first side of the substrate;

a second feed line disposed on a second side of the substrate;

at least two dipoles, each dipole bifurcated so as to have a first half disposed on one side of the substrate and a second half disposed on another side of the substrate;

wherein:

one half of each dipole is connected to one of the feed lines, and the other half of each dipole is connected to the other feed line; and the dipoles are arranged symmetrically around a first axis of the substrate.

2. The antenna according to claim 1, wherein the first feed line is vertically arranged along the first axis of the substrate, and the second feed line is opposite the first feed line and not physically connected to the first feed line.

3. The antenna according to claim 2, wherein the dipoles are further arranged parallel to the first axis of the substrate.

4. The antenna according to claim 1, further comprising:

at least one feed part on the first side of the substrate connecting the dipoles corresponding to the first feed line to the first feed line; and at least one feed part on the second side of the substrate connecting the dipoles corresponding to the second feed line to the second feed line;

wherein said feed parts are in series with each other with respect to other feed parts also connected to the same feed line.

5. The antenna according to claim 4, wherein each feed part is horizontally disposed on the substrate.

6. The antenna according to claim 5, wherein each feed part defines a second axis, and the first half of each dipole is disposed on a first side of the second axis, and the second half of each dipole is disposed on an opposite side of the second axis.

7. The antenna according to claim 6, wherein the second axis is perpendicular to the first axis.

8. The antenna according to claim 4, wherein:

the dipoles are arranged symmetrically around the first axis of the substrate;

each dipole is arranged parallel to the first axis; and each feed part defines a second axis perpendicular to the first axis, and one half of each dipole is disposed on a first side of the second axis, and the other half of each dipole is disposed on a second side of the second axis opposite to the first side.

9. The antenna according to claim 8, wherein:

each dipole is symmetrically disposed with another dipole about the first axis, and each pair of symmetrically disposed dipoles comprise a dipole set; and each dipole set is separated by approximately 43 mm from at least one other dipole set also symmetrically disposed about the first axis.

10. The antenna according to claim 8, wherein each feed line is approximately 1 mm wide.

11. The antenna according to claim 8, wherein each feed part is 0.5 mm wide and 12 mm long.

12. The antenna according to claim 8, wherein each dipole is separated by 8.4 mm from a dipole that is symmetrically disposed to it with respect to the first axis.

13. The antenna according to claim 8, wherein each dipole is a ½ wavelength dipole.

14. The antenna according to claim 8, wherein each dipole half is a ¼ wavelength dipole.

15. The antenna according to claim 1, wherein the first feed line includes a balun structured to impedance match and balance a coaxial cable connected to the first and second feed lines.

16. The antenna according to claim 1, wherein the dipoles have dimensions suited for one of the 2.4 GHz RF band and 5 GHz RF band.

17. An antenna, comprising:

a substrate;

a first feed structure disposed on a first side of the substrate;

a second feed structure, independent of the first feed structure, disposed on a second side of the substrate; and a plurality of bifurcated dipoles;

wherein:

a first part of each bifurcated dipole is disposed on the first side of the substrate and coupled to the first feed structure, and a second part of each bifurcated dipole is disposed on the second side of the substrate and coupled to the second feed structure;

the plurality of dipoles are dispersed symmetrically about a first line of symmetry.

18. The antenna according to claim 17, wherein the substrate is a substantially planar dielectric.

19. The antenna according to claim 17, wherein each dipole is connected in series to each respective feed structure.

20. An antenna according to claim 17, wherein the dipoles are disposed at equidistant points from each other along the first and second feed structures.

21. The antenna according to claim 17, wherein:

each dipole is bifurcated along a horizontal axis; and the horizontal axis intersects the midpoint of each dipole.

22. The antenna according to claim 17, wherein the antenna provides a substantially omni-directional gain pattern.

23. The antenna according claim 17, wherein the first and second feed structures are balanced.

24. The antenna of claim 17, wherein the feed structures comprise:

a main feed line; and a plurality of test points perpendicularly coupled to the main feed line.

25. The antenna of claim 17, wherein the plurality of dipoles are parallel to and perpendicularly coupled to at least one of the feed structures.

26. The antenna according to claim 17, wherein the substrate does not contain vias or other connections between the sides of the substrate.

27. An antenna, comprising:

a subsatrate;

a first feed structure disposed on a first side of the substrate;

a second feed structure, independent of the first feed structure, disposed on a second side of the substrate;

a plurality of bifurcated dipoles; and a balun coupled to one of the feed structures;

wherein:

a first part of each bifurcated dipole is disposed on the first side of the substrate and coupled to the first feed structure, and a second part of each bifurcated dipole is disposed on the second side of the substrate and coupled to the second feed structure; and the balun comprises a lower portion and a tapered portion.

28. The antenna according to claim 27, wherein the balun is coupled to one of the feed structures at a location below a balance point of the feed structure.

29. The antenna according to claim 27, further comprising an output connector coupled to the balun.

30. The antenna according to claim 29, wherein the output connector is a coaxial cable.

31. The antenna according to claim 29, wherein:

the output connector includes a grounded conductor connected to the balun; and the output connector further includes a second conductor connected to the feed structure not connected to the balun.

32. The antenna according to claim 29, wherein the output connector is connected to an output device.

33. The antenna according to claim 32, wherein the output device is a RF device.

34. An antenna, comprising:

a substrate;

a first feed structure disposed on a first side of the substrate;

a second feed structure, independent of the first feed structure, disposed on a second side of the substrate;

a plurality of bifurcated dipoles; and at least one testing strip connected to at least one of the feed structures;

wherein a first part of each bifurcated dipole is disposed on the first side of the substrate and coupled to the first feed structure, and a second part of each bifurcated dipole is disposed on the second side of the substrate and coupled to the second feed structure.

35. The antenna according to claim 34, wherein the testing strip is metallic.

36. The antenna according to claim 34, further comprising contact points connected to the testing strips.

37. An antenna, comprising:

a substrate;

a first feed structure dipsosed on a first side of the substrate;

a second feed structure substantially perpendicularly coupled to the first feed structure;

a third feed structure dipsosed on a second side of the substrate;

a fourth feed structure substantially perpendicularly coupled to the third feed structure a dipole set, wherein the dipole set comprises a first dipole half disposed on the first side of the substrate and a second dipole half dipsosed on the second side of the substrate;

wherein the first dipole half comprises a first quarter-wavelength dipole connected to an end of the second feed structure and a second quarter-wavelength dipole connected to an opposite end of the second feed structure;

wherein the second dipole half comprises a third quarter-wavelength dipole connected to an end of the fourth feed structure and a fourth quarter-wavelength dipole connected to opposite end of the fourth feed structure;

a second dipole set connected to the first and second feed structures.

38. The antenna according to claim 32, wherein:

the first and second quarter-wavelength dipoles are each substantially perpendicular to the second feed line and connected at a bifurcation point to the second feed structure, and the third and fourth quarter-wavelength dipoles are each substantially perpendicular to the fourth feed line and connected at a bifurcation point to the fourth feed structure.

39. The antenna according to claim 37, wherein:

the first feed structure is coupled to the midpoint of the second feed structure, and the third feed structure is coupled to the midpoint of the fourth feed structure.

40. The antenna according to claim 37, wherein:

the substrate has a thickness between approximately 0.1 and 0.7 millimeters;

the first and third feed structures are 1 millimeter wide;

the second and fourth feed structures are 0.5 millimeters wide and 8.4 millimeters in length;

the first, second, third, and fourth quarter-wavelength dipoles are 1.8 millimeters wide and 13 millimeters in length;

the first and second dipole sets are separated along the first feed structure by 43 millimeters.

41. The antenna according to claim 37, wherein the dipole sets are connected in series along the first and third feed structures.

42. An antenna according to claim 41, wherein the dipole sets in series are disposed at equidistant points along the first and third feed structures.

43. The claim according to claim 42, wherein the dipole sets are disposed approximately 43 millimeters from each other along first and third feed structures.

44. The antenna according to claim 37, further comprising:

a balun connected to the first feed structure;

an output connector connected to the balun;

a tuning strip connected to the third feed structure;

wherein the output connector connected to the tuning strip.

45. The antenna according to claim 44, wherein the output connector is a first grounded conductor connected to the balun;

the output device further comprising a second conductor connected to the third feed structure.

46. The antenna of claim 37, wherein the antenna operates in frequency range between 5.15 and 5.35 GHz.

47. A wireless communication device having an antenna for receiving and transmitting high-frequency signals, comprising:

a substrate;

at least one dipole that is bifurcated and arranged on opposite sides of the substrate;

wherein:

each bifurcated part of the dipole is coupled to an independent, balanced antenna feed structure; and the dipole is arranged symmetrically about a first axis of the substrate.

48. The wireless communication device according to claim 47, further comprising a plurality of dipoles that are bifurcated and arranged on opposite sides of the substrate.

49. A wireless communication device having an antenna for receiving and transmitting high-frequency signals, comprising:

a substrate;

an independent, balanced antenna feed structure;

at least one dipole that is bifurcated and arranged on opposite sides of the substrate;

wherein:

each bifurcated part of the dipole is coupled to the independent, balanced antenna feed structure; and the independent, balanced feed structure comprises a balun having a lower potion and a tapered portion.

* * * * *